US006416427B1

(12) United States Patent
Quinn

(10) Patent No.: US 6,416,427 B1
(45) Date of Patent: Jul. 9, 2002

(54) GOLF DRIVING RANGE SIGHTING DEVICE

(76) Inventor: John Patrick Quinn, 8375 Dover Dr., Granite Bay, CA (US) 95746

( * ) Notice: Subject to any disclaimer, the term of this patent is extended or adjusted under 35 U.S.C. 154(b) by 26 days.

(21) Appl. No.: 09/610,044

(22) Filed: Jul. 5, 2000

Related U.S. Application Data

(60) Provisional application No. 60/142,440, filed on Jul. 6, 1999.

(51) Int. Cl.[7] ..... A63B 57/00

(52) U.S. Cl. ..... 473/407; 473/150

(58) Field of Search ..... 473/407, 409, 473/150; 33/227, 262, 278, 279, 280, 289, 750, 751

(56) References Cited

U.S. PATENT DOCUMENTS

| | | | | | |
|---|---|---|---|---|---|
| 2,090,658 | A | * | 8/1937 | Zak | 33/262 |
| 2,164,463 | A | * | 7/1939 | Mather | 33/262 |
| 2,419,597 | A | * | 4/1947 | Rushmore | 33/279 |
| 3,186,092 | A | * | 6/1965 | Bertas | 33/289 X |
| 3,300,862 | A | * | 1/1967 | Judge | 33/278 |
| 3,907,288 | A | * | 9/1975 | Hudak | 473/407 |
| 3,937,475 | A | | 2/1976 | Gentiluomo | |
| 4,126,314 | A | * | 11/1978 | Martin | 473/407 X |
| 4,762,325 | A | | 8/1988 | McCleery | |
| 4,798,385 | A | | 1/1989 | Tegart | |
| 4,928,973 | A | | 5/1990 | Perry et al. | |
| 5,052,114 | A | | 10/1991 | Levenson et al. | |
| 5,395,115 | A | | 3/1995 | Ferns et al. | |
| 5,513,841 | A | | 5/1996 | Takagi | |
| 5,588,652 | A | | 12/1996 | Lang | |
| 5,653,642 | A | | 8/1997 | Bonacorsi | |
| D415,234 | S | | 10/1999 | Feinbloom et al. | |

FOREIGN PATENT DOCUMENTS

| | | |
|---|---|---|
| JP | 7257071 | 10/1995 |
| JP | 7213669 | 5/1996 |
| JP | 10080509 | 3/1998 |

* cited by examiner

*Primary Examiner*—Raleigh W. Chiu
(74) *Attorney, Agent, or Firm*—Dennis DeBoo

(57) ABSTRACT

A handicap-calibrated visual sighting device enabling a golfer at the driving range to rate each shot they make in regard to the shots accuracy on a substantially lateral plane for bringing competition to the driving range and providing an entertaining environment that enhances a golfers' concentration and aids in the improvement of the golfers' accuracy.

16 Claims, 9 Drawing Sheets

| Fig. 6A |
| --- |
| Fig. 6B |

GOLF DRIVING RANGE SIGHTING DEVICE

CROSS-REFERENCE TO RELATED APPLICATIONS

This application is entitled to the benefit of Provisional Patent Application Ser. No. 60/142,440 filed Jul. 6, 1999.

FIELD OF THE INVENTION

The present invention relates generally to a sighting device and, in particular, to a golf driving range sighting device and a method for use thereof.

BACKGROUND OF THE INVENTION

In order to improve their accuracy and consistency, golfers practice at the driving range. While nearly every golfer starts with a high level of focus and concentration on improvement, nearly all golfers become bored and unfocused by the time they finish their bucket of balls. It has long been an elusive goal of practicing golfers to be able to maintain their level of concentration and focus while practicing in order to improve the accuracy in their golf game.

Heretofore, a goal of several inventors was to bring competition to the driving range. It has long been recognized that competition enhances a golfer's ability to stay focused at the range. Elaborate, expensive and many complicated approaches have been proposed to allow the scoring of a player's shots. U.S. Pat. No. 5,588,652 to Lang (1996) proposes the landing area of the driving range be set up with a grid pattern with scoring based on proximity of a hit golf ball to an intended grid location This patent would require extensive modification to existing ranges or would require a newly designed range to incorporate its design for a target grid pattern. U.S. Pat. No. 4,798,385 to Tegart (1989) proposes a double-ended course where drives are hit to one area, chipping to a separate area and putting to a third area. This also requires either a newly designed range or an extensive and expensive reconstruction of an existing range to enable a golfer to play a simulated round of golf. Others have suggested rotating buildings as seen in U.S. Pat. No. 5,395,115 to Ferns et al. (1995) or alarm sounding devices to alert persons of a hole-in-one at the driving range as in U.S. Pat. No. 5,653,642 to Bonacorsi (1997).

These implementations are problematic in that they all require modifications to the range to provide the environment for competition. The ability to implement competitive scoring to keep the golfer interested does not require movable targets on the range, or camera equipment with computers and automated ball identification apparatus as explained in U.S. Pat. No. 5,513,841 to Takagi (1996). Golf is a game of distance and accuracy, but primarily it is a game of left and right.

Hence, the disadvantages of the prior art are, inter alia:

1) Cost to manufacture;
2) Cost for driving range site construction or reconstruction;
3) Complexity;
4) Mechanical reliability.

Accordingly, there is a need for a means of keeping golfers at the driving range interested, focused and concentrating on each and every shot without the disadvantages associated with the prior art. Furthermore, there is a need for the practice time to be entertaining.

SUMMARY OF THE INVENTION

The present invention is distinguished over the known prior art in a multiplicity of ways. For one thing, the present invention provides means for enabling a golfer to judge the accuracy of each shot taken at the driving range and for enabling the golfer to rate or score the accuracy of each shot without the elaborate range altering schemes or expensive equipment as found in the prior art.

The present invention comprises a hand-held device with adjustable flags that when held at arms-length produces a visual window of acceptability both left and right of an intended target and may be calibrated by both the golfers' ability level (handicap) and their height. Further, it sets lateral limits for what is considered an excellent shot regardless of their handicap (e.g., a birdie-type shot).

The visual angles that are created by moving a set of vertical flags on the hand-held device away from a target flag on the hand-held device, that may be aligned to the intended target, creates views of the driving range landing area that are increasingly easy to hit as they become more separated.

The present invention further includes a sighting device that is calibrated to the golfer's height (and correspondingly related arms-length) and to their ability level. The calibrations create an equivalent sight-angle for golfers of varying height. The calibration related to the player's ability level or handicap creates a visual target on the practice range with lateral limits defined. These lateral limits appear as "goal-posts" when the device is sighted. The golfer hits their shot and views the landing of their shot in relation to the intended target (typically a flag or yardage marker). The adjustable "goal-posts" provide the means of rating each shot as a birdie-type (very good), par-type (average for their handicap) or as a bogey-type shot (below average for their handicap).

Scoring provides the means for a golfer to maintain the desirable concentration level, by making each shot count. The games that can be played provide the entertainment value and concentration. Furthermore, when used with a practice scorecard it provides the accuracy rating that allows golfers to improve by knowing which clubs they are accurate with and which they are not.

OBJECTS OF TIE INVENTION

Accordingly, a primary object of the present invention is to provide a new, novel and useful golf driving range sighting device and a method for use thereof.

A further object of the present invention is to provide a golf driving range sighting device which creates a visual perspective of the driving range in relation to the intended target that challenges the golfer.

Another further object of the present invention is to provide a golf driving range sighting device which creates a visual perspective of the driving range in relation to the intended target that entertains the golfer.

Another further object of the present invention is to provide a golf driving range sighting device which creates a visual perspective of the driving range in relation to the intended target that visually informs the golfer on the rating of every golf shot hit.

Another further object of the present invention is to provide a golf driving range sighting device which provides the feedback necessary to improve golfing accuracy.

Another further object of the present invention is to provide a golf driving range sighting device that provides an inexpensive implementation of a scoring system at the driving range.

Yet another object of the present invention is to provide a golf driving range sighting device that has the ability to challenge golfers of varying skill levels equally.

Still yet another object of the present invention is to provide a golf driving range sighting device that has the ability to calibrate the sighting angles based on golfer height (and their orthopedically related arm length).

These and other objects and advantages will be made manifest when considering the following detailed specification when taken in conjunction with the appended drawing figures.

DESCRIPTION OF PREFERRED EMBODIMENTS

Figure 1:
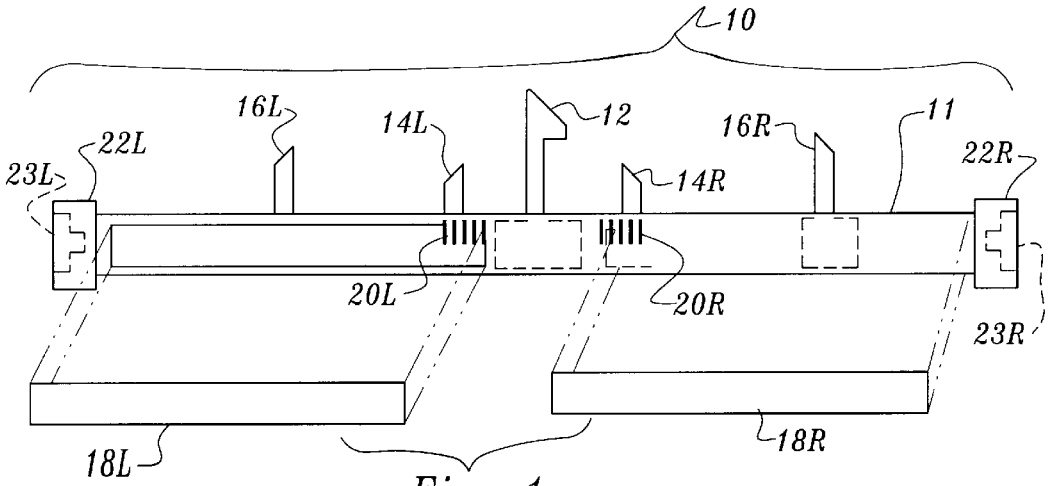
FIG. 1 is a front view of the sighting device.

Considering the drawings, wherein like reference numerals denote like parts throughout the various drawing figures, reference numeral 10 is directed to the sighting device assembly according to the present invention. The remaining reference numerals throughout the various drawing figures are as follows:

11 elongated support or body
12 target flag
13 landing area target
14L birdie-indicator flag (left)
14R birdie-indicator flag (right)
16L par-indicator flag (left)
16R par-indicator flag (right)
18L par calibration sticker (left)
18R par calibration sticker (right)
20L height calibration marks (left)
20R height calibration marks (right)
22L end cap (left)
22R end cap (right)
23L left bore 23R right bore
24 golfer's eye
26 golfer's arm
28 golfer's belt loop on hip
30 retractor
32 retracting string
34 retractor end plug
36 target line
38 a plurality of tee boxes
40 birdie-limit line
42 par-limit line
44 pivot point
46 gun-like assembly
48 trigger
50 set stops
52 telescopic tube assembly
54 area of desirability
56 area of acceptability
58 area of undesirability
64 number of balls hit per club
66 wedges
68 irons
70 woods
72 score
74 date played
76 totals per club
78 advertising space
80 shot-accuracy
82 baseball-out
84 baseball-single
86 baseball-double
88 bowling-gutter ball
90 bowling-spare
92 bowling-strike FIGS. 1 through 5 illustrate one preferred form of the present invention. Specifically, and referring to FIG. 1, the sighting device assembly 10 is comprised of the following: an elongated support or body 11, a fixed placement target flag 12, two adjustable birdie flags 14L and 14R (one on each side of the target flag 12), two adjustable par flags 16L and 16R, two calibration stickers 18L and 18R having calibration markings indicating handicaps from 0 to 36, two sets of calibration marks 20L and 20R for calibrating for the height of the golfer, and two end caps 22L and 22R which respectively couple to a left and a right end of support 11. A retractor 30 (please see FIG. 3) is coupled to either end of the support 11 of the sighting device assembly 10 via end plug 34 coupling within either bore 23L or bore 23R which are disposed in end caps 22L and 22R, respectively.

Figure 2:
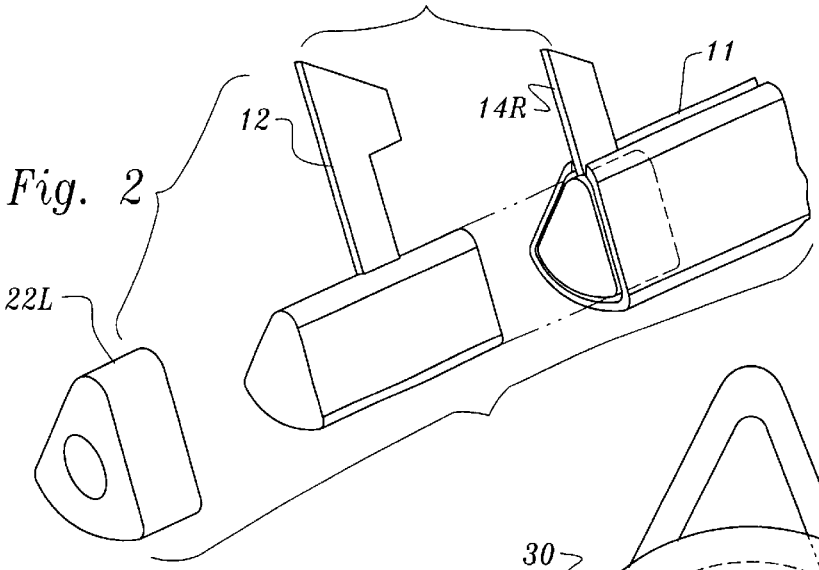
FIG. 2 is an end view of the sighting device, showing assembly of friction-fit flags.

FIG. 2 illustrates an enlarged view of a slotted hollow tube making the body 11 of the assembly 10. The five flags (the two birdie flags 14L and 14R, the two par flags 16L and 16R and the target flag 12) are slid in from one end with only the center target flag 12 being secured in place with glue or other retaining means. For example, the order in which the flags would be slid into body from the left end would be as follows 16R, 14R, 12, 14L and 16L, respectively. Once the flags are slid into slotted hollow tube making the body 11 the end caps 22L &22R are secured with glue or other retaining means such as clips. Preferably, the end caps are designed to allow for a flush fit when end plug 34 is inserted into one of the two end caps. Left-handed golfers insert the end plug 34 with the retracting string 32 into the right end cap 22R. Right-handed golfers insert the end plug 34 with the retracting string 32 into the left end cap 22L.

Figure 3:
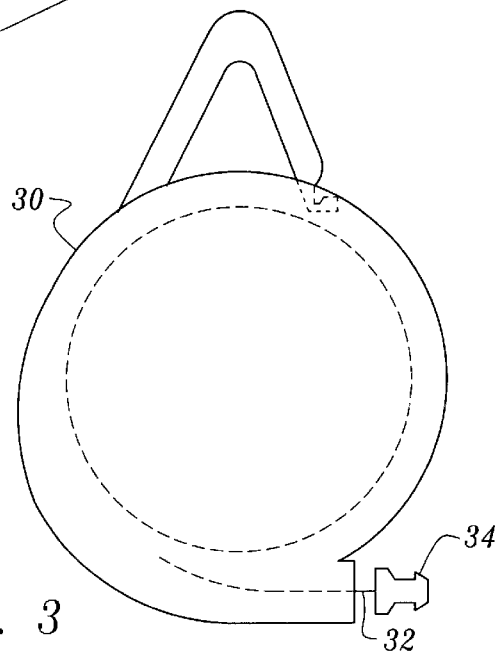
FIG. 3 is a view of the retracting device that attaches to the golfer's hip.
Figures 6, 6A, 6B:
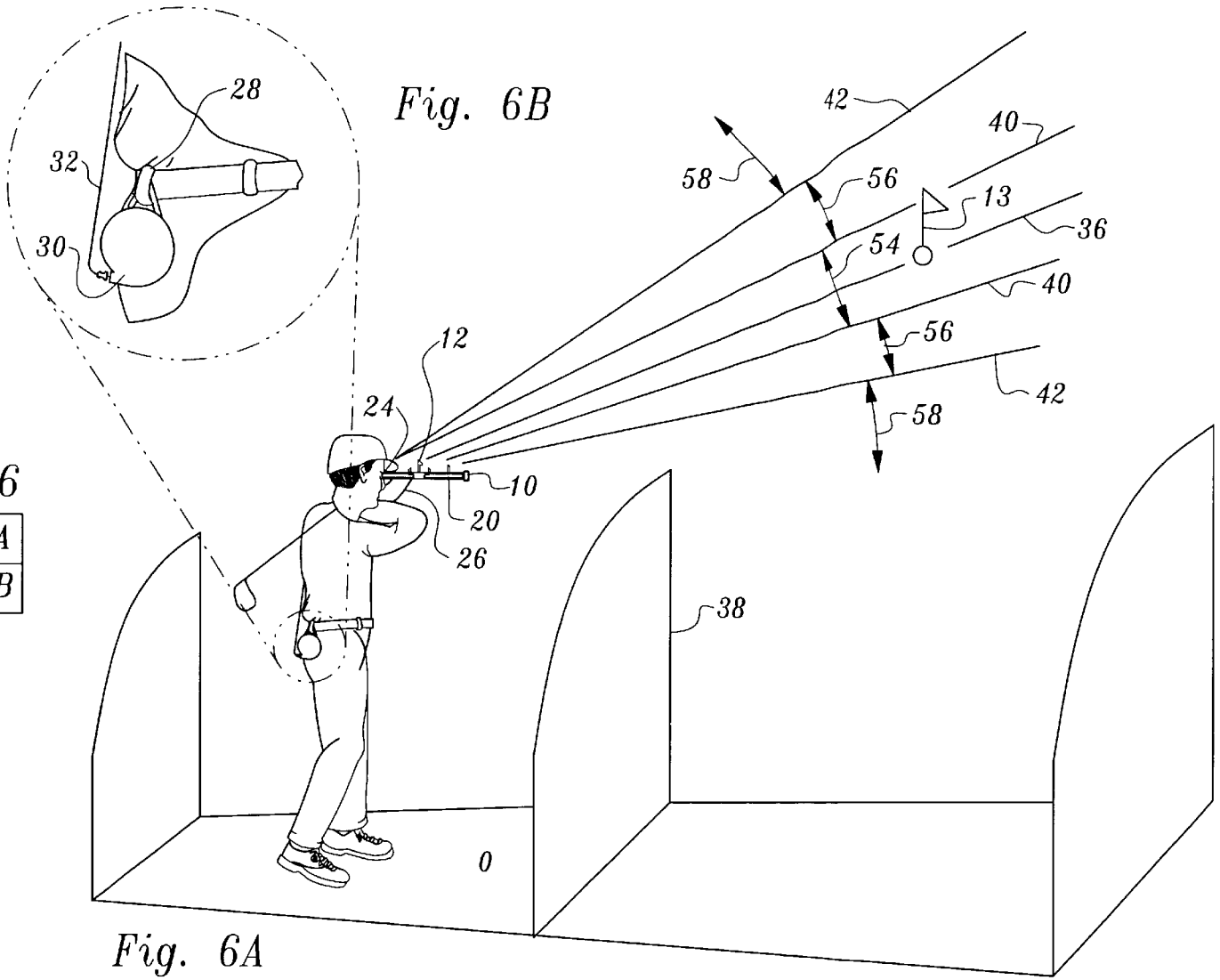
FIG. 6 shows a golfer at the driving range sighting in a shot.

FIG. 3 illustrates the spring-loaded retractor 30 with retracting string 32 and end plug 34 used to attach sighting device assembly 10 to the golfer's hip belt loop 28 (please see FIG. 6).

Figures 4, 5:
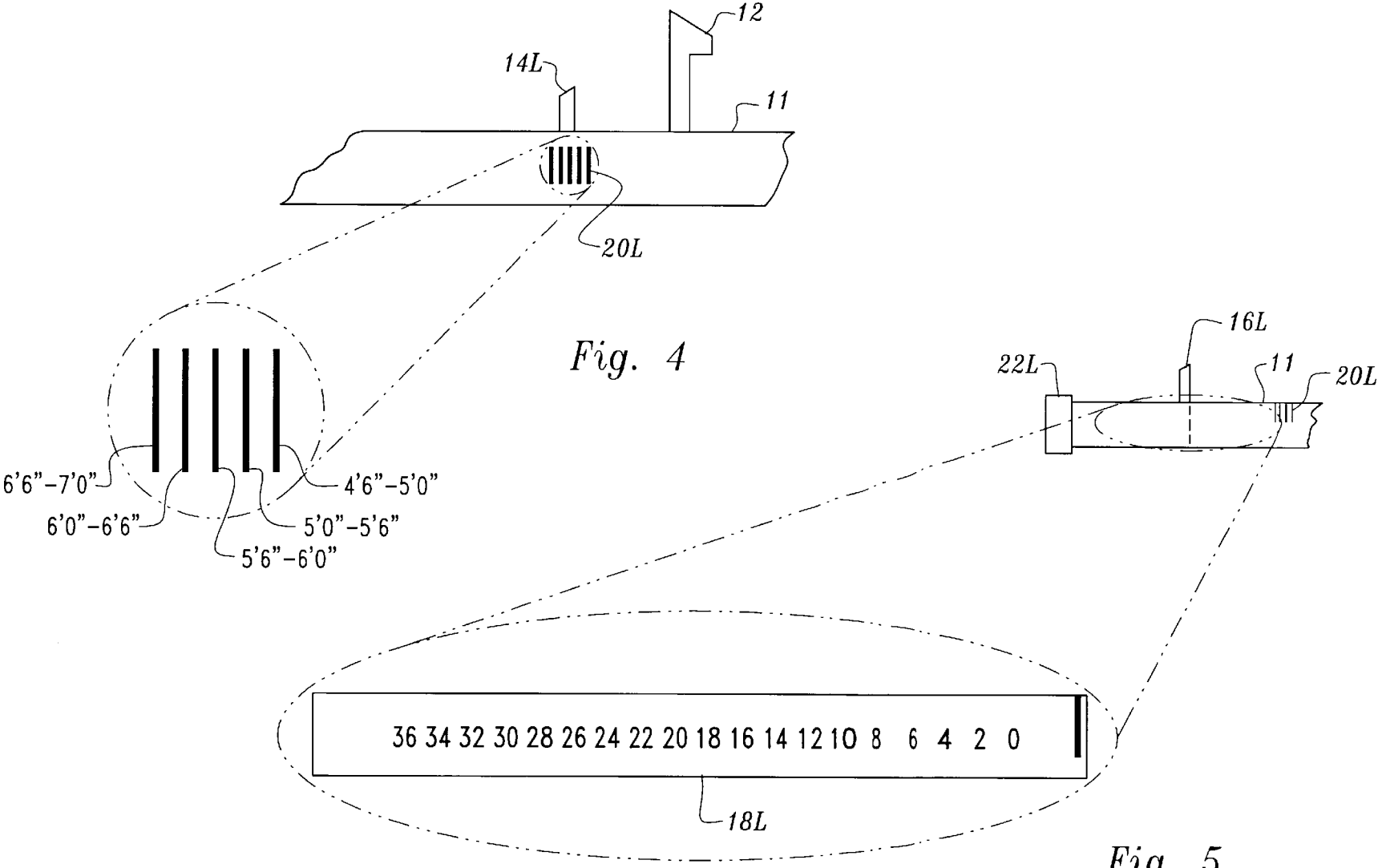
FIG. 4 is an enlarged view of the left height calibration markings.
FIG. 5 is an enlarged view of the left ability level calibration marks for positioning the PAR flag.

FIG. 4 illustrates the calibrations necessary to account for the variety of golfers' heights. The distances between the five calibration marks 20L and 20R, which are related to the changes in angle required to keep the sight angle from the golfer's eye 24 between the target flag 12 and the birdie flags 14L and 14R, equivalent for golfers ranging in height from four feet six inches to seven feet tall. For each six inch height change in the golfer, the calibration mark used to line up the bird flags 14L and 14R and the calibration stickers 18L and 18R are adjusted one notch.

Calibration mark spacing was based on information gathered from pathology reports on arm lengths as they relate to a persons height.

FIG. 5 illustrates the left calibration sticker 18L alignment to the left height calibration marks 20L and the relationship between the golfer's ability level or handicap with the location of the par-indicator flags 16L.

FIG. 6 illustrates a right-handed golfer's position after hitting a shot on the driving range with his left arm 26 extended and the sighting device assembly 10 held horizontally, perpendicular to the target line 36. The retractor 30 is shown attached to the golfers left hip belt loop 28 with retracting string 32 connecting the retractor 30 to the sighting device assembly 10. The golfer's eye 24 is used to track the flight of the golf ball, and by aligning the target flag 12 with the target on the driving range landing area 13 (typically a flag or yardage marker), the golfer notes the position on the landing area where the ball makes contact with the ground in relation to the amount left or right of the target flag 12 on the sighting device assembly 10. For example, a sighting means is provided by the target flag 12 and any one of the other flags such that when the target flag 12 is aligned with a remote target (e.g., the landing area target 13) the position of the ball between the target flag 12 and the birdie flag 14L, the par flag 16L, the birdie flag 14R, or par flag 16R reveals the accuracy of the shot.

Figure 7:
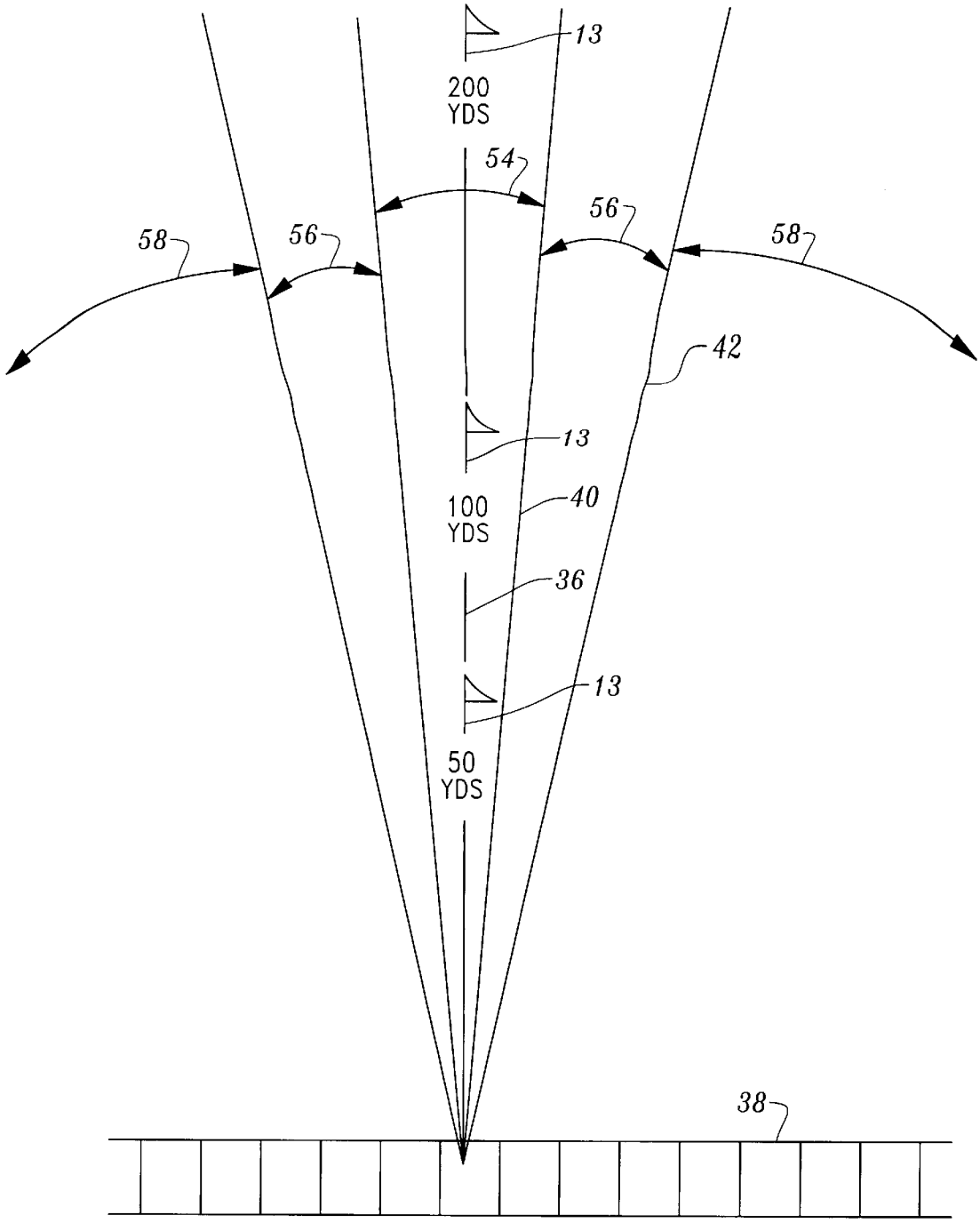
FIG. 7 shows a top view of a driving range with angles produced by the sighting device.

FIG. 7 illustrates a top view of the driving range and the visual angles created by the sighting device assembly 10 for a given handicap setting. The view presents to the golfer an ever-widening lateral limit for what is considered an excellent (birdie) average (Par) and below average (bogey) type shots, dependent on distance. Scoring is based on where the ball is hit to in lateral proximity to the landing area target 13.

Figure 8A:
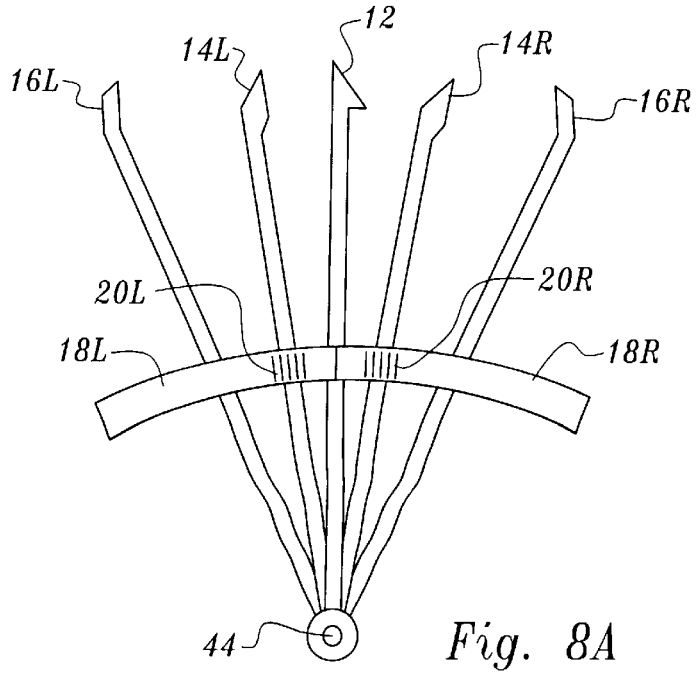
FIG. 8*a* through 8*c* illustrate a variety of alternate embodiments of the present invention.

FIG. 8*a* illustrates an alternative to create the same visual angles being achieved by the preferred embodiment. The pivot-point 44 provides for the separation of the target flag 12, the birdie flags 14L and 14R, and the par-indicator flags 16L and 16R that are each disposed at an end of an elongated rod.

Figure 8B:
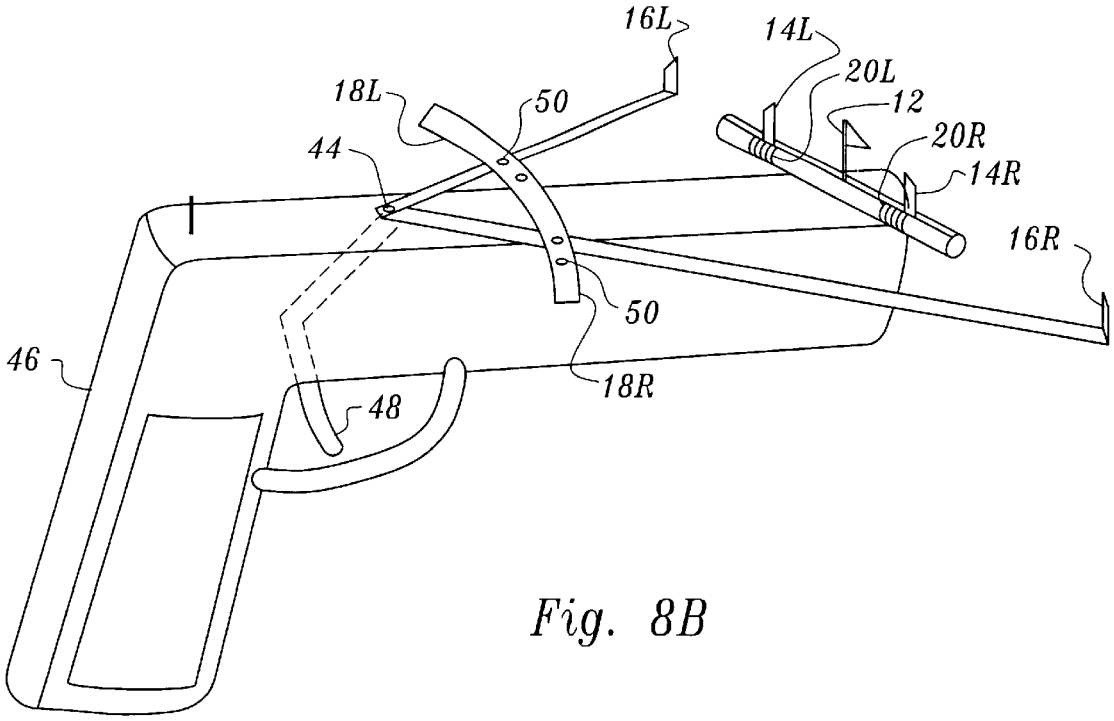

FIG. 8*b* illustrates a similar embodiment described in FIG. 8*a* mounted on a gun-like assembly 46 with a trigger 48 that is used to separate the par-indicator flags 1 6L & 1 6R.

Figure 8C:
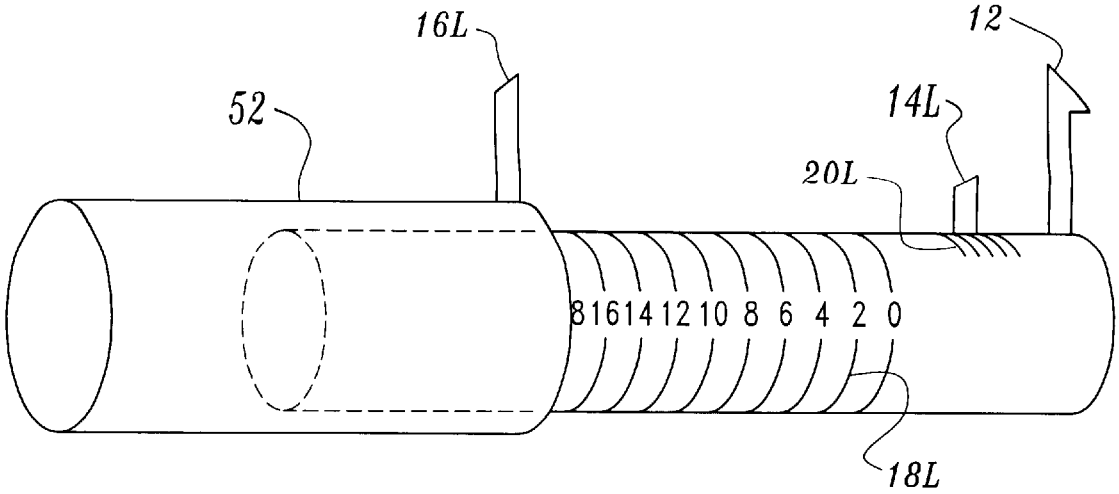

FIG. 8*c* illustrates the use of telescopic tubes 52 to create the separation of the target flag 12 from the par-indicator flag 16L.

Figure 9:
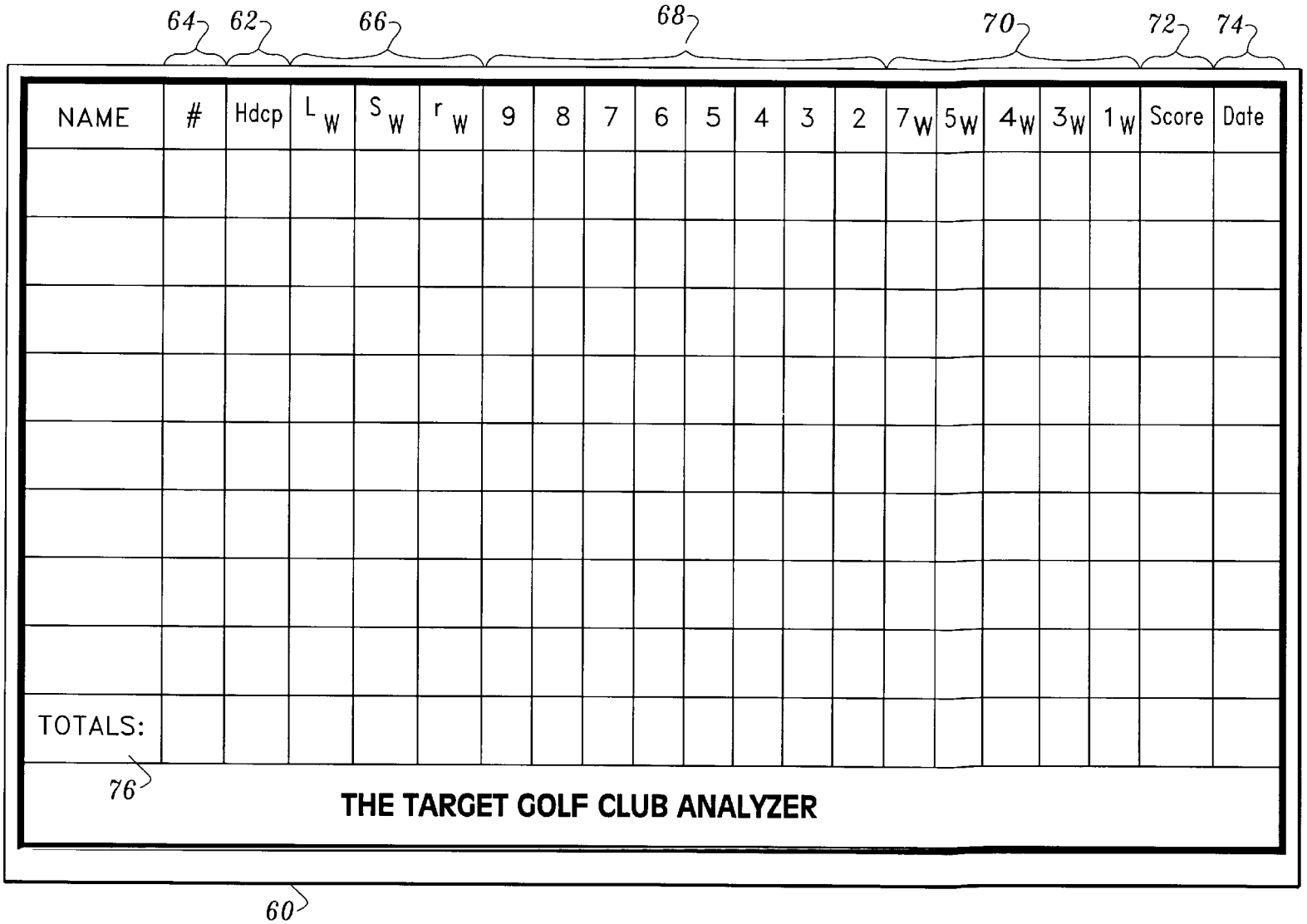
FIG. 9 illustrates an embodiment of the scorecard used for practice.

To create a game that challenges them and keeps their concentration level up, golfers in one exemplary embodiment of the present invention may employ a scorecard as depicted in FIG. 9 and a set of rules as follows:

1) Adjust sighting device assembly 10 to your height and handicap.
2) Declare a specific landing area target 13 within your distance ability for each club being hit.
3) Hit three to six balls for each club in your bag toward intended target (depending on the size bucket of balls).
4) For each ball hit to the area of desirability 54 score −1 (birdie-type shot).
5) For each ball hit to the area of acceptability 56 score +0 (par-type shot).
6) For each ball hit to the area of undesirability 58 score +1 (bogey-type shot).
7) Record your score per club 66–70 on practice round scorecard 60 and repeat steps two through seven until all clubs have been used.
8) Record the date of your round 74, your score 72, your handicap setting 62 and save for comparison to other rounds.

In another exemplary embodiment to play a competitive round using a conventional scorecard may use the following rules:

1) Adjust sighting device assembly 10 to your height and handicap.
2) Declare a specific landing area target 13 and determine distance.
3) Hit a ball toward intended landing area target 13.
4) Sight shot using driving range device held squarely at arms-length. Reduce target distance from hole yardage on scorecard, for each shot that was hit "cleanly" and landed in the area of desirability 54 or in the area of acceptability 56. Cleanly hit shots should land within twenty-five yards, front or back, of your intended landing area target 13.
5) Once distance on scorecard for the hole your playing has been reduced to zero; hit at least two short-iron shots toward a short distance landing area target 13, making a minimum of one shot within your area of acceptability 56 or your area of desirability 54.
6) "Birdie Opportunities" are capitalized on by hitting at least one shot within the area of desirability 54 and hitting both short-iron shots within your area of desirability 54 or within your area of acceptability 56.
7) An alternative "Birdie Opportunity" can be noted when any two shots for a given hole land within the area of desirability 54.
8) Count each shot taken, except shots where contact with the ground is not seen.
9) "Birdie Opportunities" reduce score for the hole by one.
10) "Eagle Opportunities" require every shot for the hole, including two short-iron shots be hit within the area of desirability 54.
11) "Eagle Opportunities" reduce score for the hole by two.
12) Play nine or eighteen holes and total score.

Figure 9A:
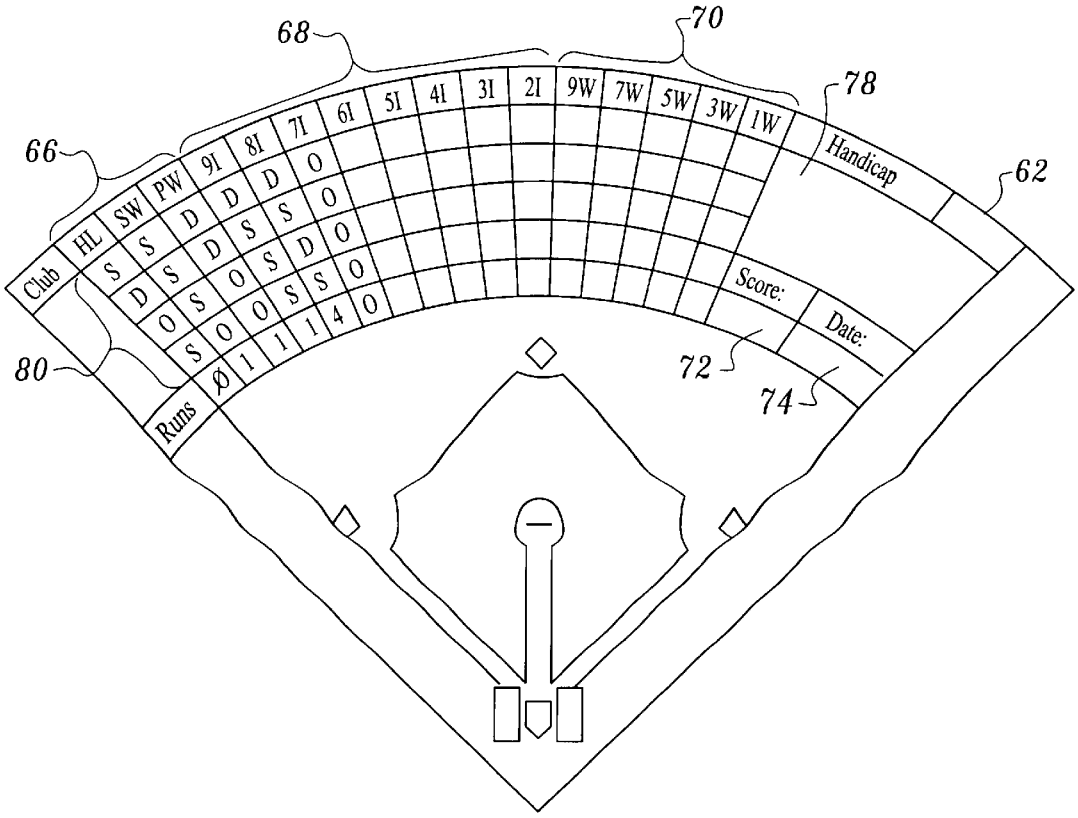
FIGS. 9*a* through 9*d* illustrate embodiments of the scorecard for a variety of competitive games.
Figure 9B:
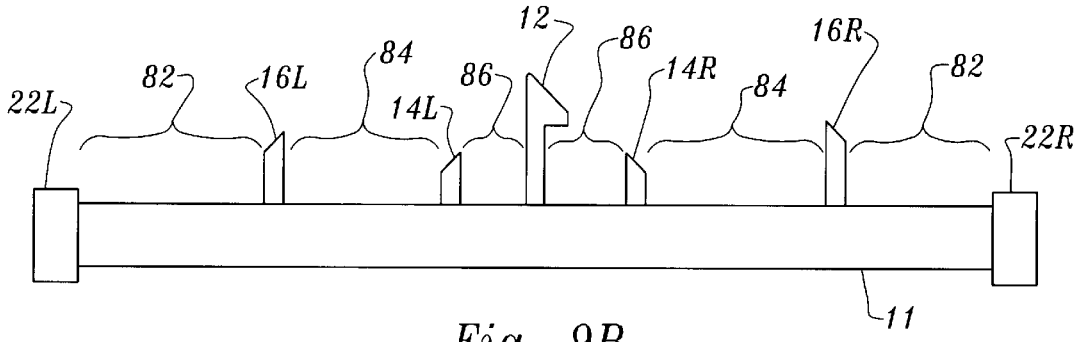

In yet another exemplary embodiment a modified game of baseball can encourage a golfer to hit a series of good shots to score runs. An embodiment of the scorecard is illustrated in FIG. 9*a* and rules for this example are as follows:

1) Using sighting device assembly 10 illustrated in FIG. 9*b*, adjust to your height and handicap.
2) For each of the clubs listed, wedges 66, irons 68, and woods 70 hit three to six shots toward an intended landing area target 13.
3) Score each shot hit within the baseball-double 86 area as a double, abbreviated as a "D" in shot-accuracy 80 section of scorecard.
4) Score each shot hit within the baseball-single 84 area as a single, abbreviated as an "S" in the shot-accuracy 80 section of the scorecard.
5) Score each shot hit within the baseball-out 84 area as an out, abbreviated as an "O" in the shot-accuracy 80 section of the scorecard.
6) Load bases before singles can score runs.
7) Clear the bases for each out hit.
8) Record runs by having consecutive hits and total in final score 72.
9) Record the date 74, handicap setting 62, and save for comparison at a later date.
10) Record your name and favorite team in the advertising space 78.

Figure 9C:
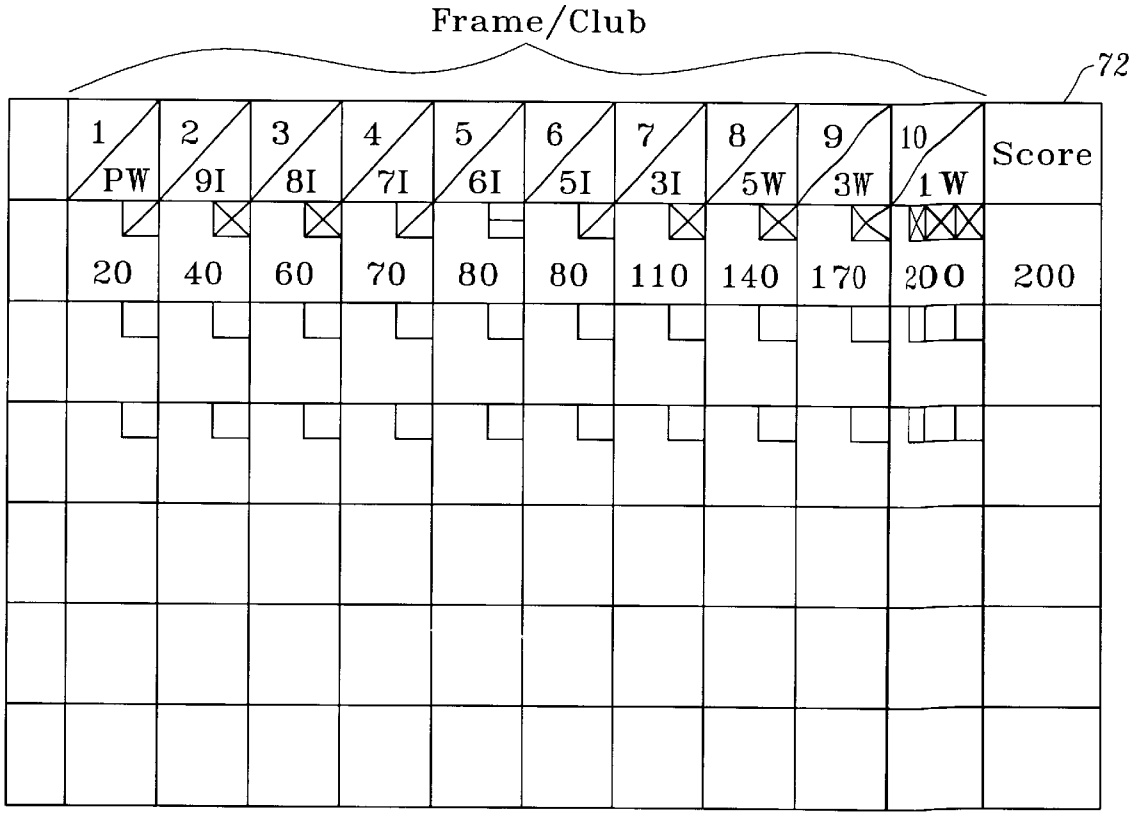
Figure 9D:
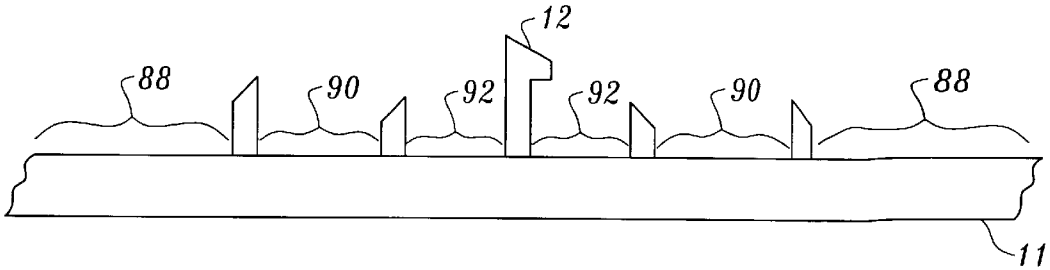

In still yet another exemplary embodiment a modified game of bowling can encourage a golfer to hit a series of good shots to score points. An embodiment of the scorecard is illustrated in FIG. 9*c*, and rules for this example are as follows:

1) For each frame as depicted in FIG. 9*c*, assign a club you will hit aligning target flag 12 with the landing area target 13 you have selected.
2) Scoring is based on FIG. 9*d* definitions of shots.
3) For each shot hit to the bowling-gutter 88 area record a zero for the frame first shot.
4) For each shot hit to the bowling-spare 90 area record a for the frame.
5) For each shot hit to the bowling-strike 92 area record an "X" for the frame.
6) Use standard scoring except all scores are a simple multiple of 10.
7) Record your total score 72.
8) Play three to six games simultaneously to prevent changing clubs every shot (depending on the size bucket of balls you got).

Conclusions, Ramifications and Scope:

In conclusion, the ramifications and scope of the present invention includes, inter alia, the following: Allowing a golfer at the driving range to find practice sessions more fin, entertaining and informative. Providing feedback on the accuracy of each shot, which places the golfer into a competitive environment where they can compete against themselves for score or against other golfers. Sighting angles produced by the hand-held sighting device are calibrated for golfers of a variety of heights to produce similar views of the driving range landing area. Golfers of a variety of skill levels can find equally challenging experiences at the range based on the calibrations for skill level that are also incorporated into the sighting device.

Some further ramifications of device 10 are that it permits golfers the ability to test:

1) new grips,
2) different clubs,
3) swing changes,
4) stances, and
5) the use of other training devices.

Furthermore, the driving range device 10 provides golfers the ability to quantify their results to determine if changes are really helping them improve their accuracy. Teaching professionals will use the rating system to get feedback from their students as to their strengths and weaknesses to help determine where more practice time should be spent. Driving ranges will be able to organize tournaments where players of a wide range of ability levels could compete.

Although the descriptions above contain much specificity, these should not be construed as limiting the scope of the invention but as merely providing illustrations of some of the presently preferred embodiments of this invention. For example, the device providing the housing for the target flag, and the calibrated par and birdie indicators could be a rifle-shaped housing or a shaped like a set of calipers, or be mounted on a stand rather than be hand-held.

Moreover, having thus described the invention, it should be apparent that numerous structural modifications and adaptations may be resorted to without departing from the scope and fair meaning of the present invention as set forth hereinabove and as described hereinbelow by the claims and their legal equivalents.

I claim:

1. A golf driving range sighting device, comprising in combination:

a support;

a plurality of spaced apart stanchions operatively coupled to said support such that any two of said plurality of spaced apart stanchions are used for sighting in a golf shot made by a golfer at a driving range.

2. The device of claim 1 wherein any two of said plurality of spaced apart stanchions are used for sighting in said golf shot made by said golfer at said driving range for quantifying golf shot accuracy relative to an intended target.

3. The device of claim 1 wherein said plurality of spaced apart stanchions includes a target flag operatively coupled to said support.

4. The device of claim 3 wherein said plurality of spaced apart stanchions includes a pair of birdie flags operatively coupled to said support such that said target flag is interposed between said birdie flags.

5. The device of claim 4 wherein said pair of birdie flags are movably coupled to said support such that said pair of birdie flags can be moved relative to said target flag.

6. The device of claim 4 wherein said plurality of spaced apart stanchions includes a pair of par flags operatively coupled to said support such that said target flag and said pair of birdie flags are interposed between said pair of par flags.

7. The device of claim 6 herein said pair of par flags are movably coupled to said support such that said pair of par flags can be moved relative to said target flag.

8. The device of claim 1 further including a plurality of calibration marks disposed on said support and a calibration tab adjustably disposed on said support and having a demarcation such that an alignment of said demarcation with each of said calibration marks calibrates said device for different heights of different golfers.

9. The device of claim 7 further including a plurality of different handicap marks disposed on said support at a location relative to at least one of said pair of said par flags such that said at least one of said par flags can be adjusted to align with one of said plurality of different handicap marks for identifying a golfer's handicap correlative to a golf shot.

10. The golf driving range sighting device of claim 1 wherein said support includes calibration markings for enabling golfers of a wide range of skill levels to rate their shots on an equivalent difficulty scale.

11. The golf driving range sighting device of claim 1 wherein said support includes calibration markings for enabling golfers of a wide range of heights to have similar sighting angles for a given skill level.

12. The golf driving range sighting device of claim 1 wherein said support includes calibration markings for enabling golfers of a wide range of heights to have similar sighting angles for a given handicap.

13. The golf driving range sighting device of claim 1 including a rating means for providing an ability to score every shot made as either excellent (birdie-type shot), average (a par-type shot), or below average (bogey-type shot) and for assigning a scoring value to each.

14. The golf driving range sighting device of claim 1 further including calibration markings indicating handicaps of a golfer.

15. The golf driving range sighting device of claim 1 further including calibration marks for calibrating for a height of a golfer.

16. A sighting device, comprising in combination:

a support:

sighting means horizontally adjustable along said support extending away from said support for sighting in a golf shot made by a golfer at a driving range for quantifying golf shot accuracy relative to an intended target;

a rating means for providing an ability to score every shot made as either excellent (birdie-type shot), average (a par-type shot), or below average (bogey-type shot) and for assigning a scoring value to each.

* * * * *